US006589000B1

(12) United States Patent
Boss

(10) Patent No.: US 6,589,000 B1
(45) Date of Patent: Jul. 8, 2003

(54) APPARATUS AND METHOD FOR FOLDING AND BINDING SHEET MEDIA

(75) Inventor: Roland Boss, Guadalajara (MX)

(73) Assignee: Hewlett-Packard Development Co., L.P., Houston, TX (US)

( * ) Notice: Subject to any disclaimer, the term of this patent is extended or adjusted under 35 U.S.C. 154(b) by 0 days.

(21) Appl. No.: 09/495,426

(22) Filed: Jan. 31, 2000

Related U.S. Application Data

(63) Continuation-in-part of application No. 09/320,060, filed on May 26, 1999, now Pat. No. 6,394,728.

(51) Int. Cl.[7] ..... B42C 11/00

(52) U.S. Cl. ..... 412/9; 412/18; 412/25; 412/37; 412/900; 412/901; 412/902

(58) Field of Search ..... 412/1, 2, 9, 18, 412/25–32, 900, 901, 902, 33

(56) References Cited

U.S. PATENT DOCUMENTS 4,101,121 A * 7/1978 Rastorguyeff ..... 270/68 A
4,701,155 A * 10/1987 Ott ..... 493/14
5,049,227 A 9/1991 Long et al.
5,054,757 A * 10/1991 Martin et al. ..... 270/45
5,183,250 A * 2/1993 Miller et al. ..... 271/222
6,086,698 A 7/2000 Spitler

FOREIGN PATENT DOCUMENTS

EP 0514699 11/1992
EP 1057654 12/2000

* cited by examiner

*Primary Examiner*—Willmon Fridie, Jr.

(57) ABSTRACT

The invention combines the binding techniques described in application Ser. No. 09/320,060 titled Binding Sheet Media Using Imaging Material with a buckle chute type folding device to form self mailers and other folded and bound or sealed document. The device for folding and binding sheet media using imaging material as the binder includes a buckle chute, a binder downstream in the paper path from the buckle chute, an input driver proximate to and upstream in the paper path from the buckle chute, and an exit driver proximate to and between the buckle chute and the binder in the paper path. The input driver directs the media sheet into the buckle chute and, in cooperation with the buckle chute, buckles the media sheet along a fold line. The exit driver receives the media sheet from the buckle chute, folds the media sheet along the fold line and directs the media sheet towards the binder. The binder then reactivates imaging material applied to the binding region of the media sheet using the toner fusing or other techniques described in the '060 application.

17 Claims, 20 Drawing Sheets

APPARATUS AND METHOD FOR FOLDING AND BINDING SHEET MEDIA

CROSS REFERENCE TO RELATED APPLICATION

This a continuation in part of application Ser. No. 09/320,060 filed May 26, 1999, now U.S. Pat. No. 6394028 titled Binding Sheet Media Using Imaging Material.

FIELD OF THE INVENTION

This invention relates to folding and binding paper and other sheet media by reactivating the same imaging material, toner, ink and the like, used to print the text or images on the sheets.

BACKGROUND OF THE INVENTION

Devices for folding and binding media sheets to form mailable letters, pamphlets, and similar documents from a single sheet are known in the art. These mailable letters are sometimes referred to as "self mailers." Conventional devices for making self mailers typically use a buckle chute folder in conjunction with an adhesive applicator and/or a moistener that activates adhesive previously applied to the sheet. Such devices often require specialized paper and the user must replenish exhausted adhesive applicators and moisteners. Conventional devices are unable to operate at the speed of modern laser printers and other image forming devices, requiring additional time for adhesive application and curing. The strength of the seal is controlled only by the type of adhesive used. Moreover, due to the necessary placement of the adhesive applicators and moisteners, adhesive residue is transferred to the components of the folding mechanism during operation. Consequently, components of the device must be coated, plated or otherwise safeguarded against adhesive build-up. Many adhesives exhibit aging problems as they deteriorate over time and the ambient environment in which they are applied often must be controlled to assure proper adhesion.

SUMMARY OF THE INVENTION

The present invention is directed to devices and methods for folding and binding sheet media using imaging material as the binder. The invention combines the binding techniques described in my copending application Ser. No. 09/320,060 titled Binding Sheet Media Using Imaging Material with a buckle chute type folding device to form self mailers and other types of folded and bound or sealed documents. The invention reduces the binding "material mix"—only paper and toner is necessary—to alleviate many of the problems associated with conventional adhesive type binders. Also, the need for staples, clips, spirals and other types of mechanical binders is reduced or eliminated. This helps reduce cost and minimize difficulties recycling or otherwise salvaging used documents.

In one apparatus embodiment of the invention, the device for folding and binding sheet media includes a buckle chute, a binder downstream in the paper path from the buckle chute, an input driver proximate to and upstream from the buckle chute, and an exit driver proximate to and between the buckle chute and the binder. The input driver directs the media sheet into the buckle chute and, in cooperation with the buckle chute, buckles the media sheet along a fold line. The exit driver receives the sheet from the buckle chute, folds the sheet along the fold line and directs the sheet towards the binder. The binder then reactivates imaging material applied to the binding region of the media sheet using the toner fusing or other techniques described in the '060 application.

It is expected that the folder will usually include multiple buckle chutes and an intermediate driver between buckle chutes. A bi-fold three panel document, for example, uses two buckle chutes, an input driver, one intermediate driver and an exit driver. Rollers are typically used for the drivers. In one version of the drivers, the input driver includes first and second rollers forming a first nip therebetween through which the media sheet is directed into the first buckle chute. The intermediate driver includes the second roller and a third roller forming a second nip therebetween through which the media sheet is received from the first buckle chute, folded and directed to the second buckle chute. The exit driver includes the third roller and a fourth roller forming a third nip therebetween through which the media sheet is received from the second buckle chute, folded and directed to the binder.

In one method embodiment of the invention, imaging material is applied to a media sheet in the pattern of a desired print image to a binding region on the sheet, the imaging material is activated in the print pattern and in the binding region, the sheet is folded into two or more panels, and the imaging material is then reactivated in the binding region to bind the panels together.

These and other embodiments of the invention are described in more detail below with reference to the drawings.

DETAILED DESCRIPTION OF THE INVENTION

The present invention utilizes the binding techniques and devices described in my copending application Ser. No.

09/320,060 in devices and methods for folding and binding media sheets to form mailable letters and other types of folded and bound or sealed materials. Application Ser. No. 09/320,060, titled Binding Sheet Media Using Imaging Material and filed May 26, 1999, is incorporated herein by reference in its entirety.

Figure 1:
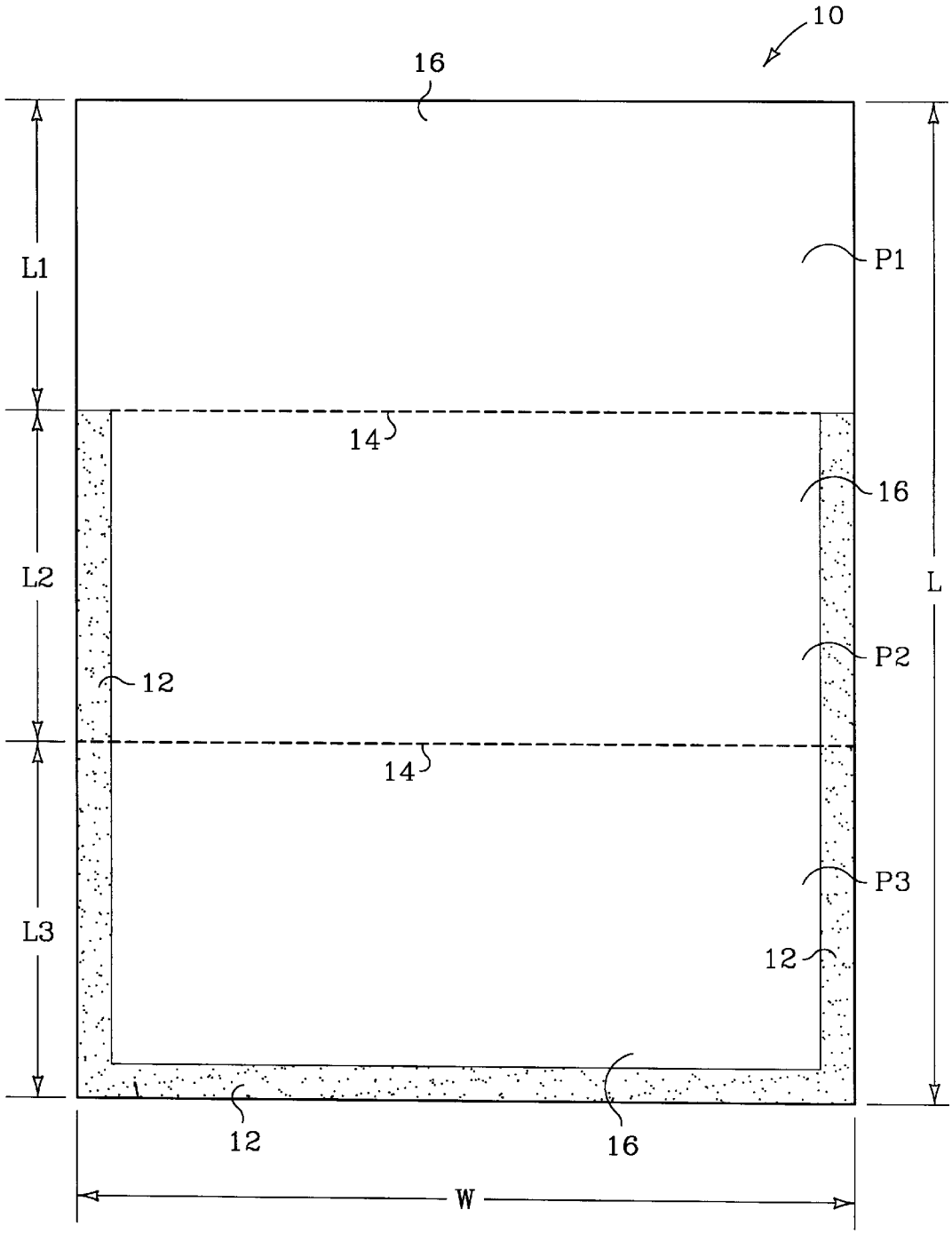
FIG. 1 is a plan view of a media sheet showing fold lines and toner binding regions.

FIG. 1 shows a media sheet 10 used to form a mailable letter. Media sheet 10 can have a variable length L and width W and can be made from paper or any other suitable material. Media sheet 10 will usually include some type of print image located on one or both sides of the sheet. Media sheet 10 also includes imaging material, such as toner, applied to one or more selected binding regions 12, preferably located along the periphery of media sheet 10. In this embodiment, binding regions 12 are selected to extend around the full open perimeter of the folded letter to seal the letter. The mailable letter is formed by folding media sheet 10 along one or more selected fold lines 14 creating two or more adjacent panels 16. The length of each panel L1, L2, L3 depends upon the placement of fold lines 14. Folding media sheet 10 along fold lines 14 operates to create a letter suitable for mailing as well as to conceal the contents of the letter.

Figure 2:
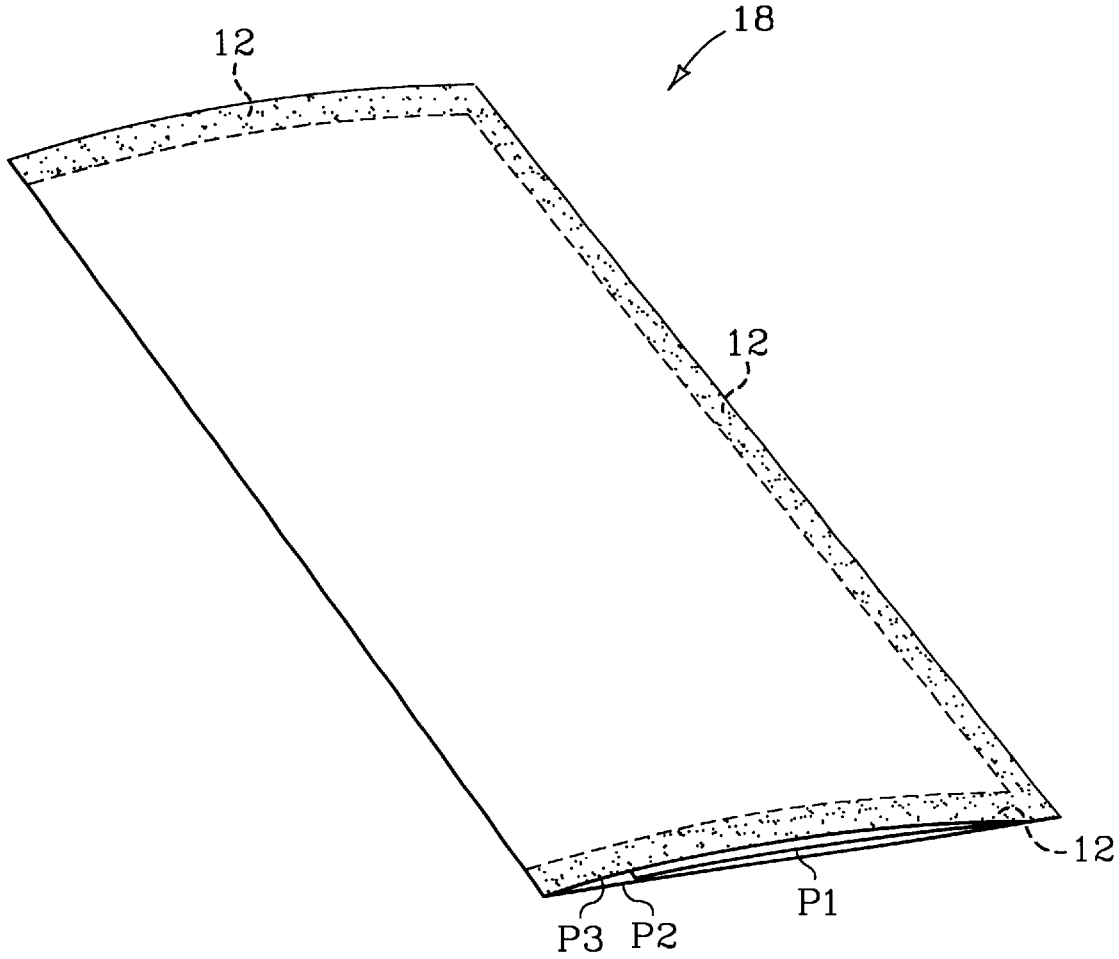
FIG. 2 is a perspective view of media sheet of FIG. 1 after is has been folded.

Referring now to FIG. 2, adjacent panels of folded sheet 18 are bound together by reactivating the imaging material applied to binding regions 12. Note that the ends of the three panels of folded sheet 18 are shown separated for illustrative purposes only. The ends would actually be bound together after reactivating the imaging material along binding regions 12. The imaging material is initially activated in the image forming device, a laser printer for example, as part of the process of developing the desired print image on each sheet. The strength of the inter-panel bond is a function of the area, density, print pattern (e.g., text, dots, lines, solid) and degree of reactivation of the imaging material applied to the binding regions 12. Increasing one or more these parameters strengthens the inter-panel bond. Decreasing one or more of these parameters weakens the bond. Bond strength may be varied from a bond stronger than the media itself to a bond that may be separated without tearing the media. A very strong "tear the paper bond" may be desirable, for example, for fully sealed confidential documents. With this type of bond, any unauthorized opening would be readily apparent and it would not be possible to reseal the document. Similarly, an intermediate strength bond in which the paper would not tear but imaging material would be left on both surfaces could be used for tamper evident confidential documents. This binding process using toner or other imaging material is described in more detail in my copending application Ser. No. 09/320,060.

Figure 3:
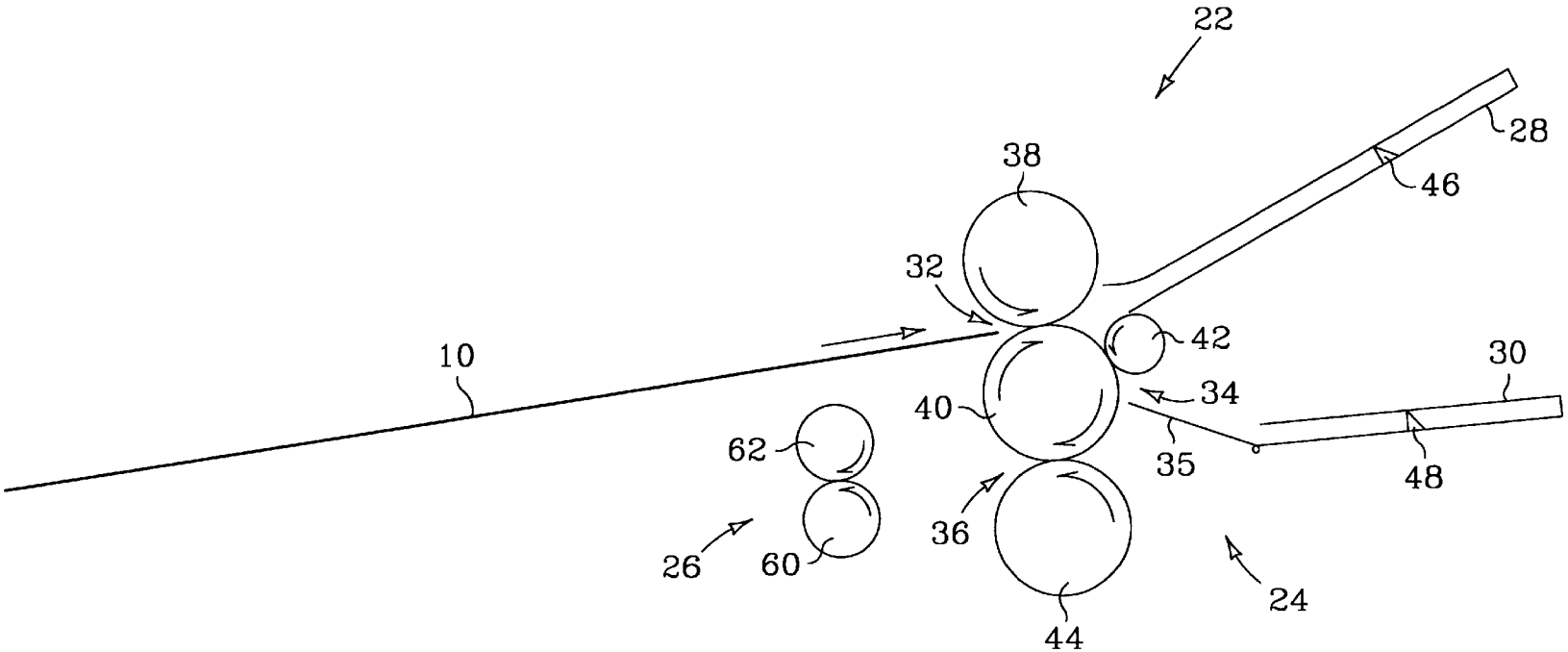
FIG. 3 is an elevation view of a folding and binding device constructed according to one embodiment of the invention.

FIG. 3 is a side elevation view of a folding and binding device 22 constructed according to one embodiment of the present invention. Referring to FIG. 3, device 22 includes a folder 24 and a binder 26. Folder 24 includes first and second buckle chutes 28 and 30 and input, intermediate, and exit drivers 32, 34 and 36 and flipper gate 35. In this embodiment, rollers 38 and 40 form input driver 32, rollers 40 and 42 form intermediate driver 34, and rollers 40 and 44 form exit driver 36. Optional adjustable stops 46, 48 are positioned in each buckle chute 28,30 to define the depth of the chute and, correspondingly, to set the position of each fold. If stops 46, 48 are omitted, each chute 28, 30 is made just long enough to make the folds at the desired position on sheet 10.

Figure 4A:
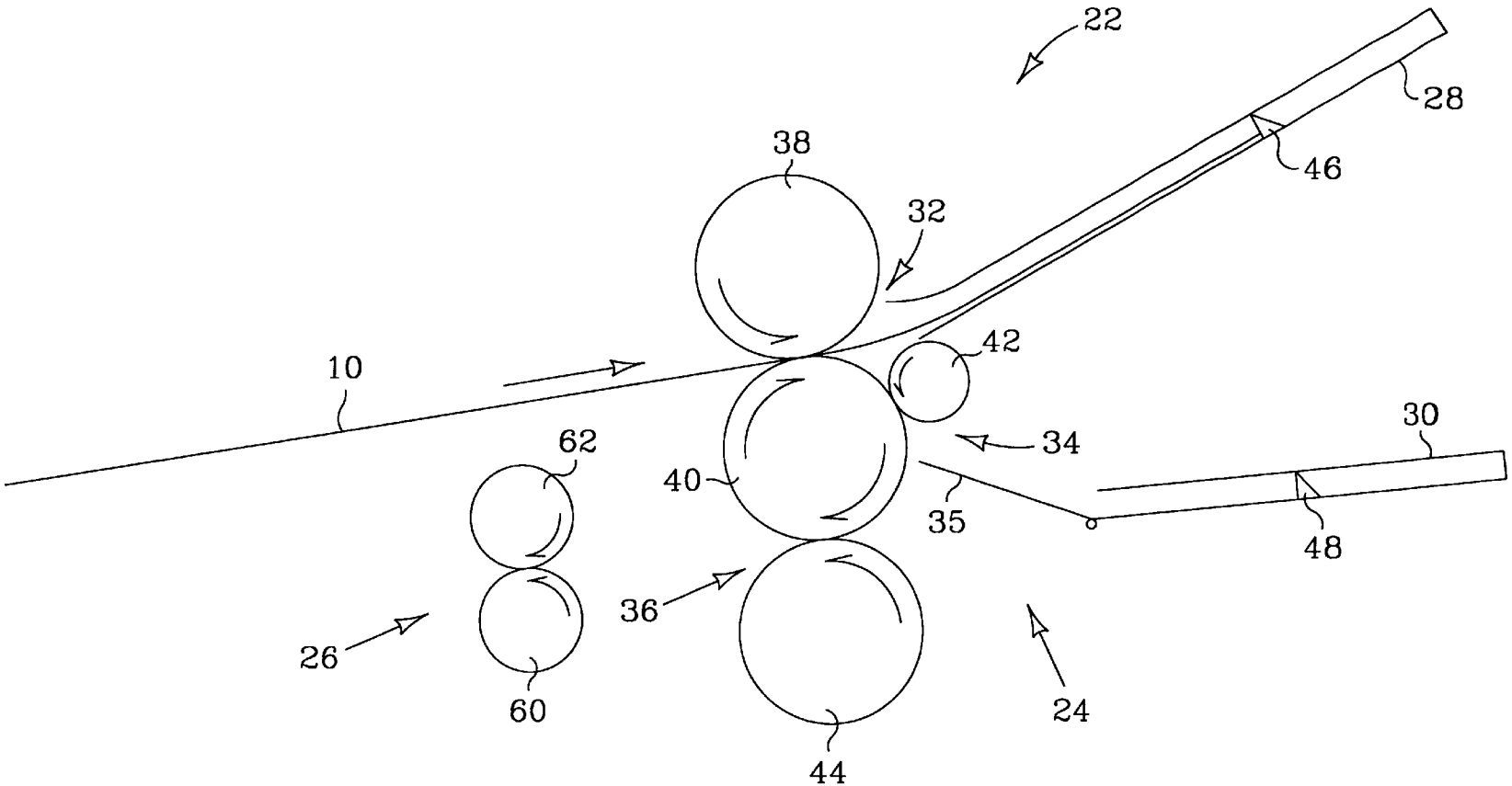
FIGS. 4A–4G are sequential elevation views of the folding and binding device of FIG. 3 showing a media sheet being folded.
Figure 4B:
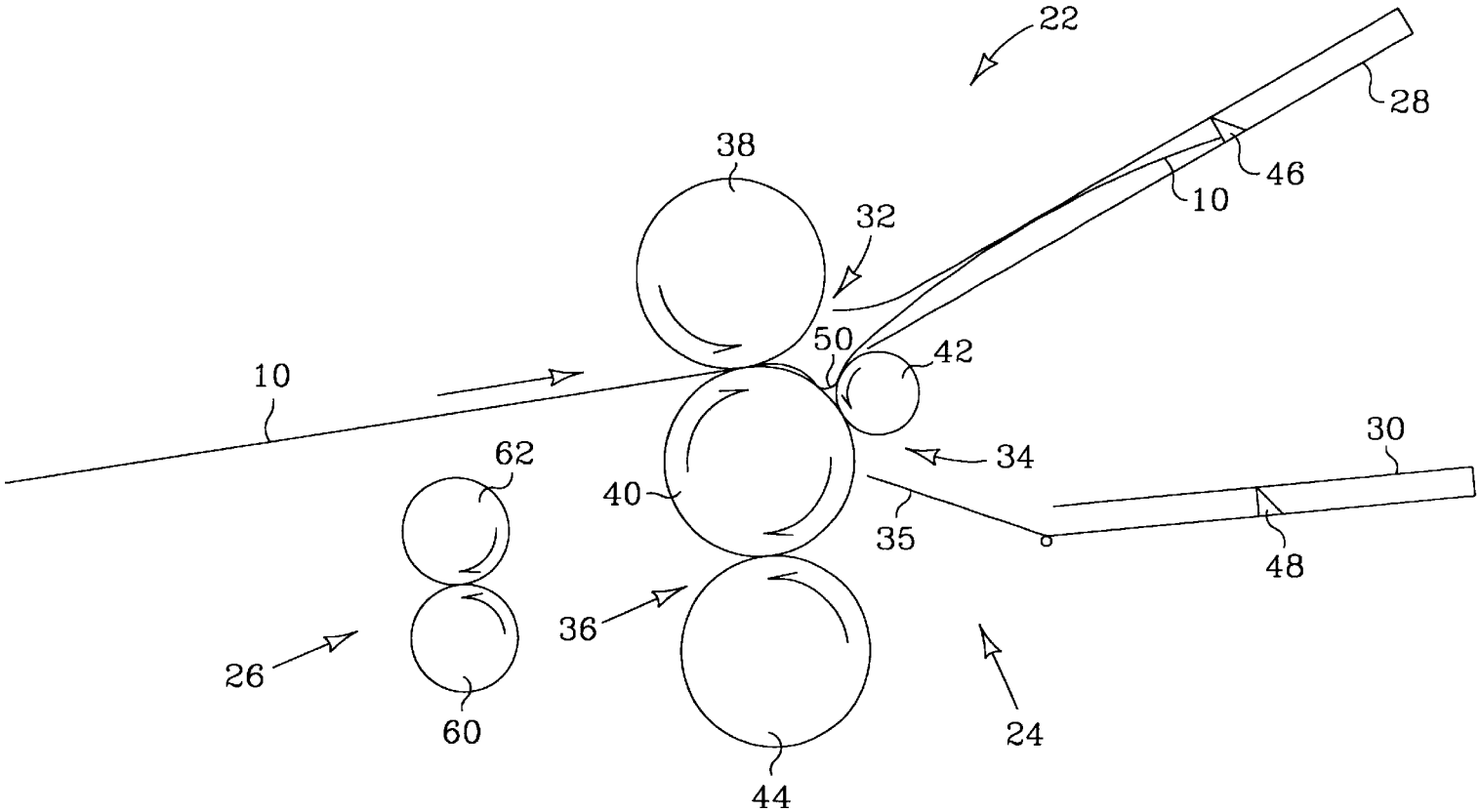
Figure 4C:
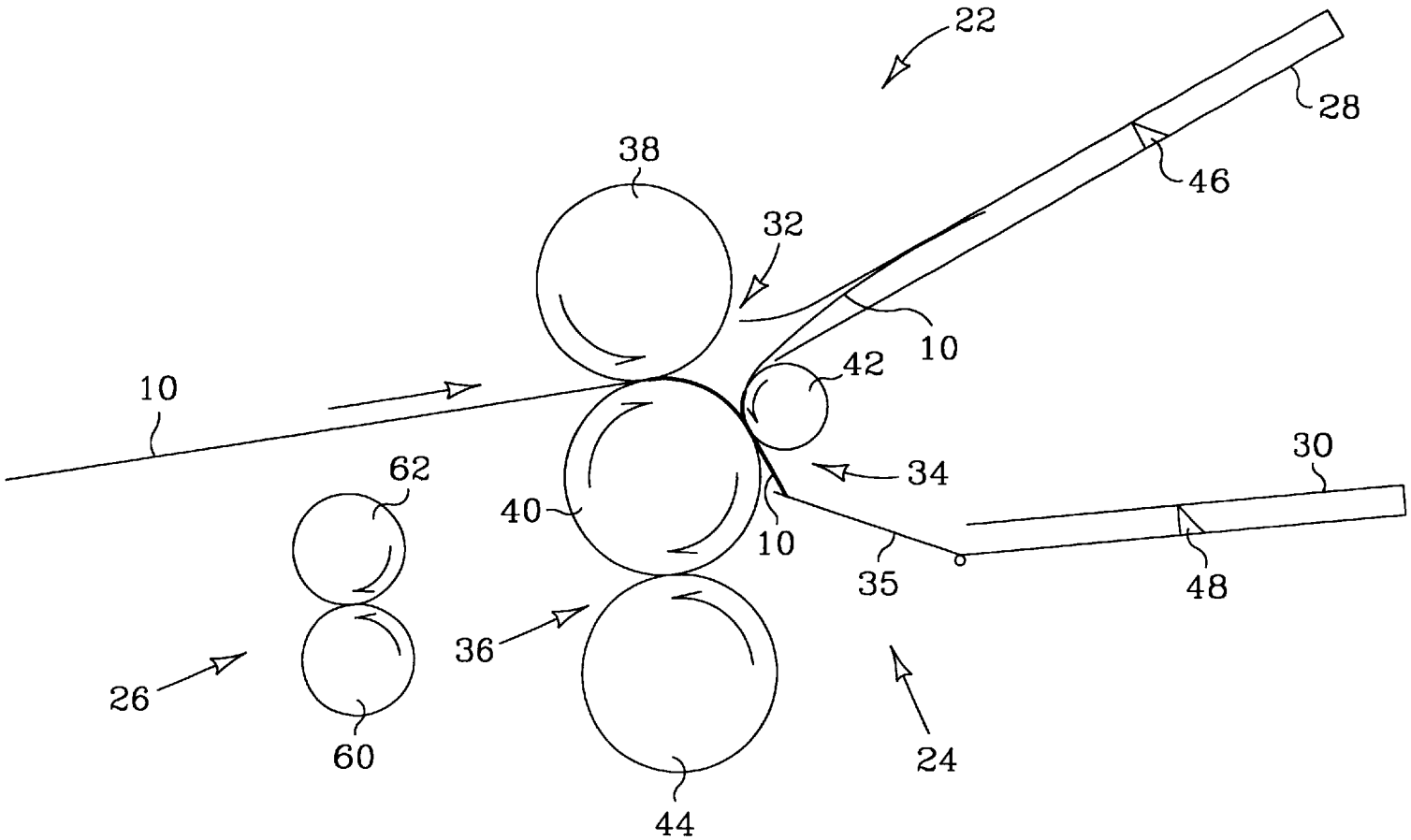
Figure 4D:
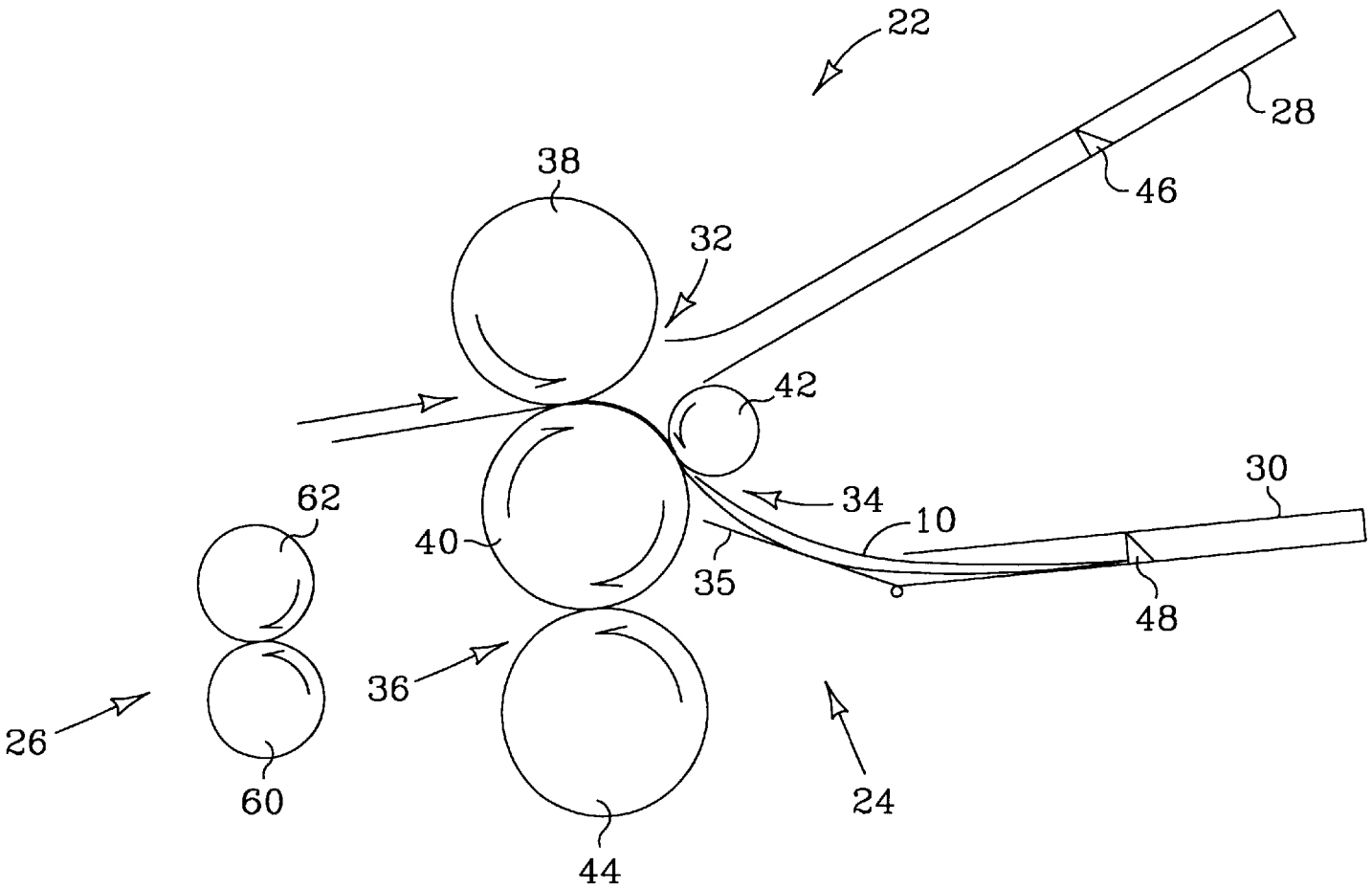
Figure 4E:
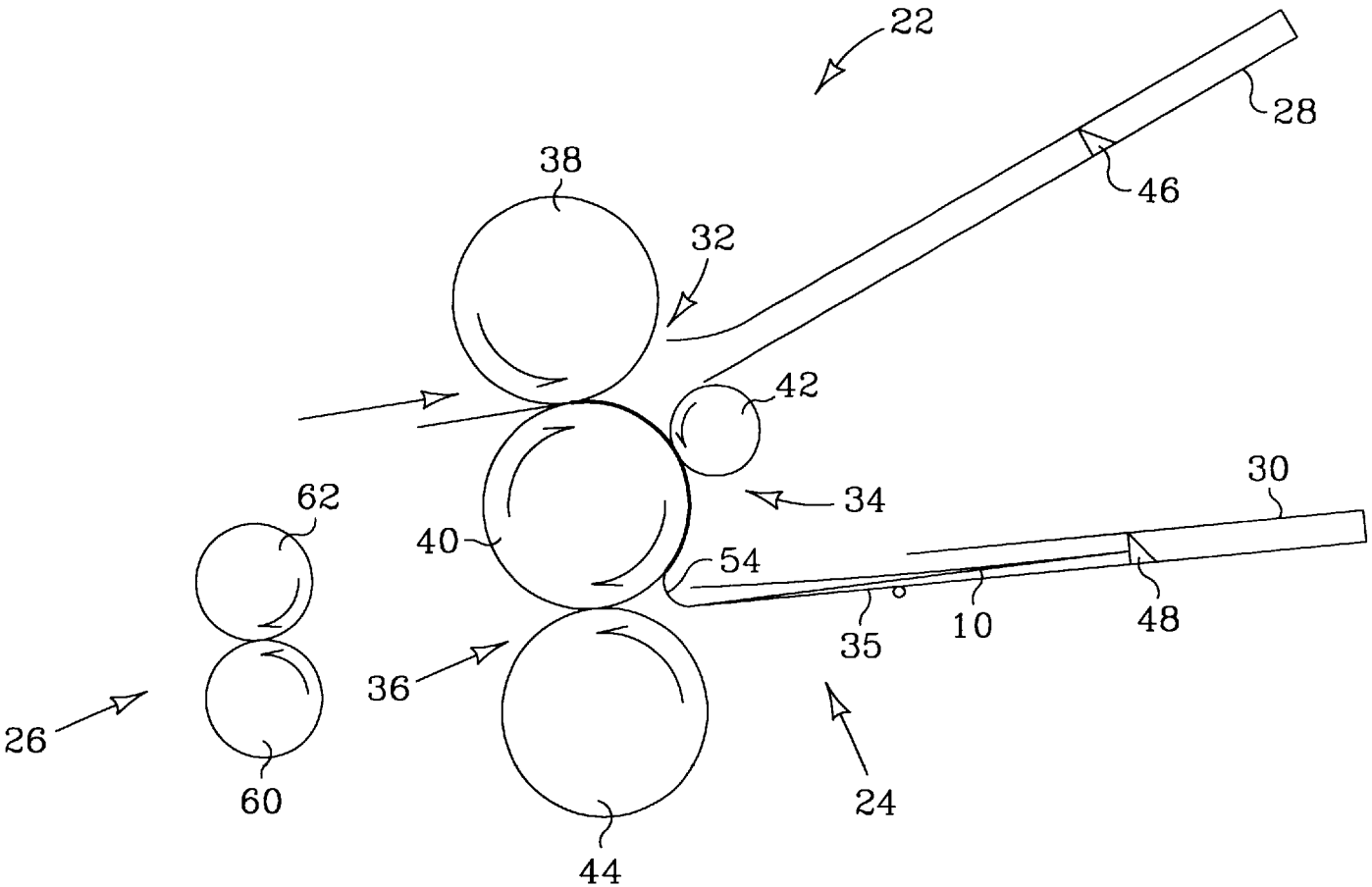
Figure 4F:
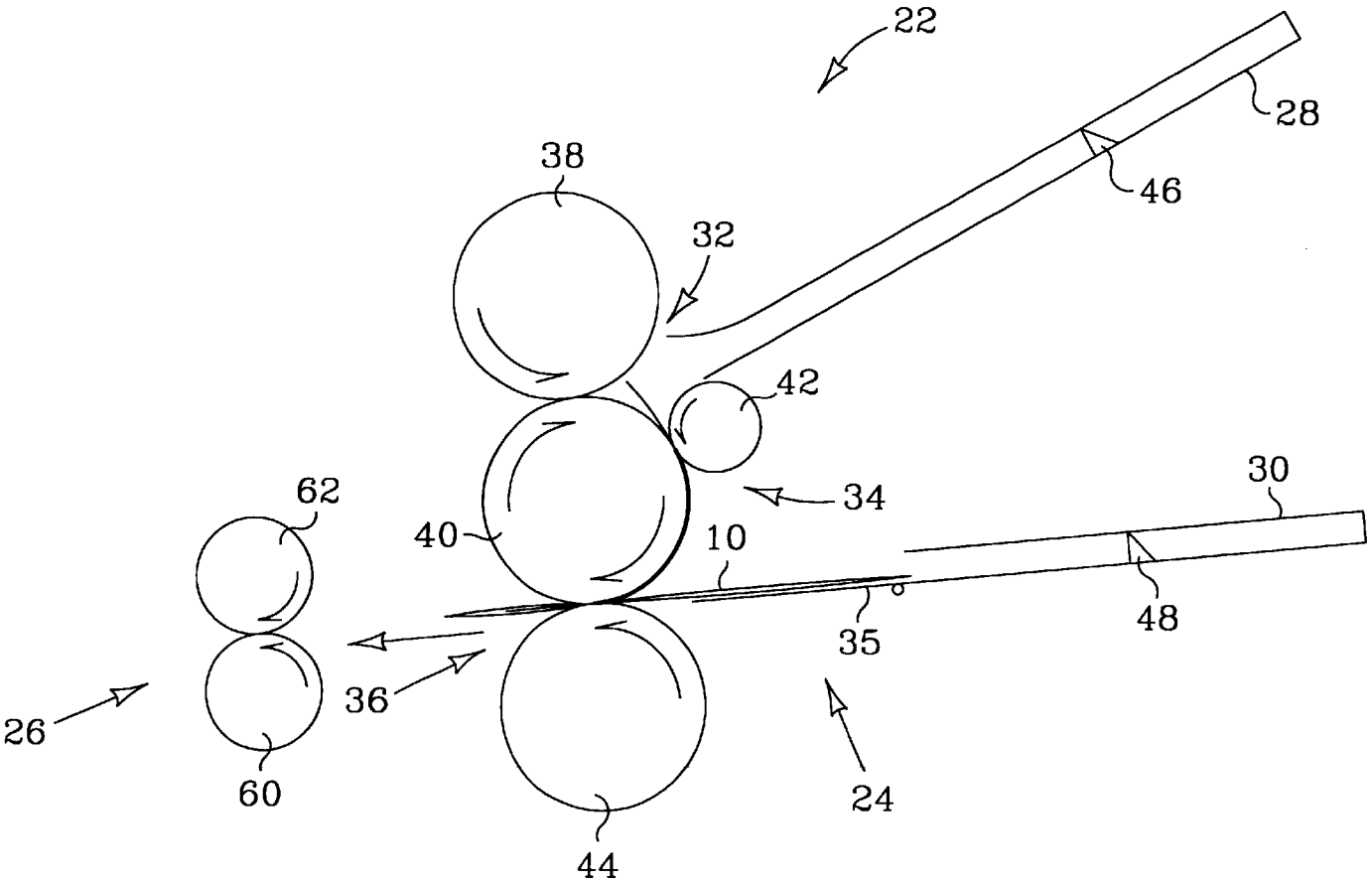
Figure 4G:
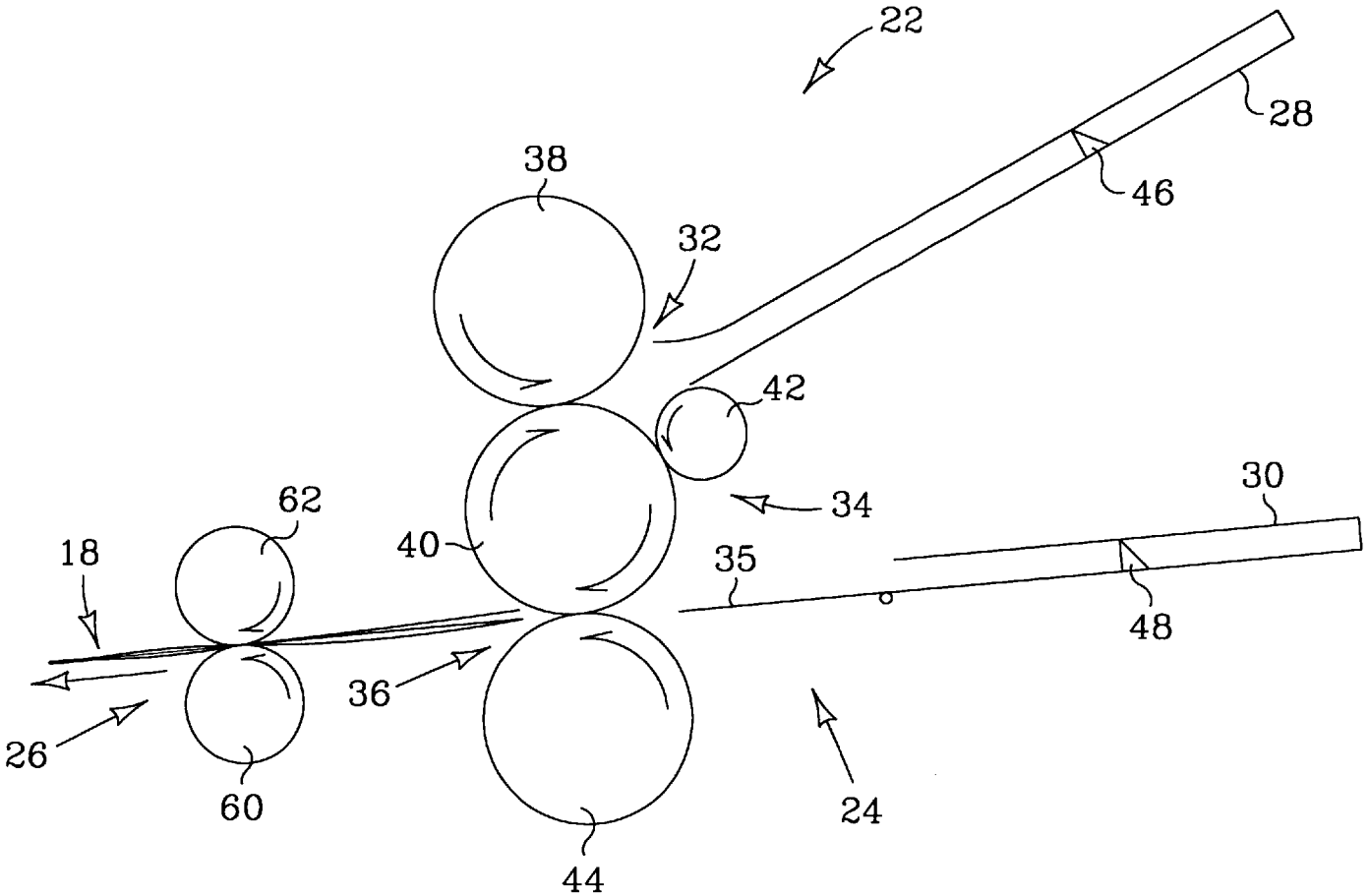

One sequence of operations to fold and seal sheet 10 will now be described with reference to FIGS. 4A–4G. Referring first to FIGS. 4A and 4B, input driver 32 receives the leading edge media sheet 10 and feeds the sheet into first buckle chute 28. As the leading edge reaches adjustable stop 46 and input driver 32 continues to feed media sheet 10, sheet 10 buckles along a first fold line 50. The position of first fold line 50 is determined by the depth of stop 46 in first buckle chute 28. Referring to FIGS. 4C and 4D, intermediate driver 34 receives sheet 10 at first fold line 50, creates the first fold along first fold line 50, and feeds media sheet 10 into second buckle chute 30 until the first fold reaches adjustable stop 48. Flipper gate 35 is up to guide sheet 10 into chute 30. Referring to FIGS. 4E–4G, intermediate driver 34, continuing to feed media sheet 10, creates a second buckle along a second fold line 54. Flipper gate 35 drops down and exit driver 36 receives sheet 10 at second fold line 54, creates a second fold along second fold line 54, and expels folded media sheet 18 to binder 26.

Figure 5:
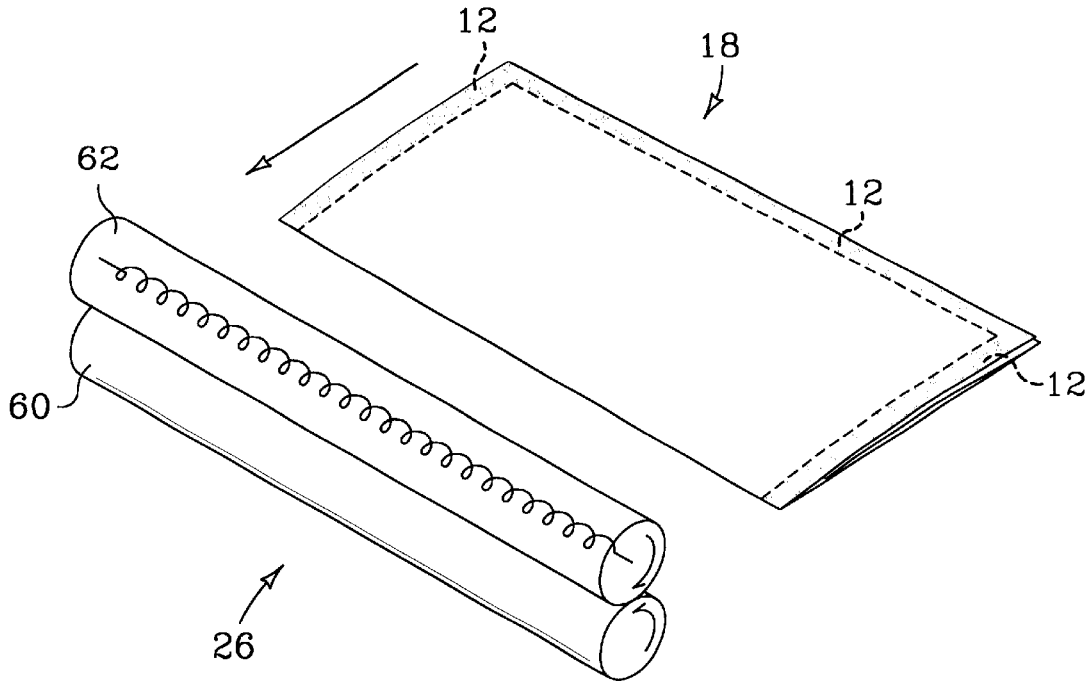
FIG. 5 is a perspective view of a heated fuser used to reactivate toner to bind and seal the folded sheets.

Referring to FIG. 5, binder 26 receives the expelled folded media sheet 18 and reactivates the imaging material applied to binding regions 12 causing binding regions 12 to adhere to an immediately adjacent panel. For laser toner imaging material, binder 26 will usually apply heat and pressure to reactivate/refuse the toner. In that case, a conventional fuser may be adapted for use as binder 26. As shown in FIG. 5, binder 26 includes a pressure roller 60 and a heated fusing roller 62 to refuse the toner imaging material. Binding rollers 60 and 62 are aligned to receive folded media sheet 18 and compress adjacent panels while heating binding regions 12. The reactivation process may be accomplished by heating the entire sheet or by selectively heating only binding regions 12, which will usually be located along the periphery of media sheet 10. Applying heat and pressure to the entire sheet could result in the printed images sticking to adjacent panels. It is expected that, if the heat and pressure is adequately controlled, the amount of sticking at the printed images will be minimal, as compared to the effect of binding in the binding regions. This is particularly true if the toner applied in the binding regions is significantly heavier in quantity and thickness, as compared to the toner used to produce printed images. In addition, since the location of binding regions 12 is known, the heat and particularly the pressure applied to sheet 10 may be applied primarily to binding regions 12. A variety of other techniques that may be used to reactivate and bind media sheet 10 are described in application Ser. No. 09/320,060. For example, depending upon the type of imaging material used, reactivation may also be accomplished using ultrasonic, magnetic, or actinic energy.

Figure 6:
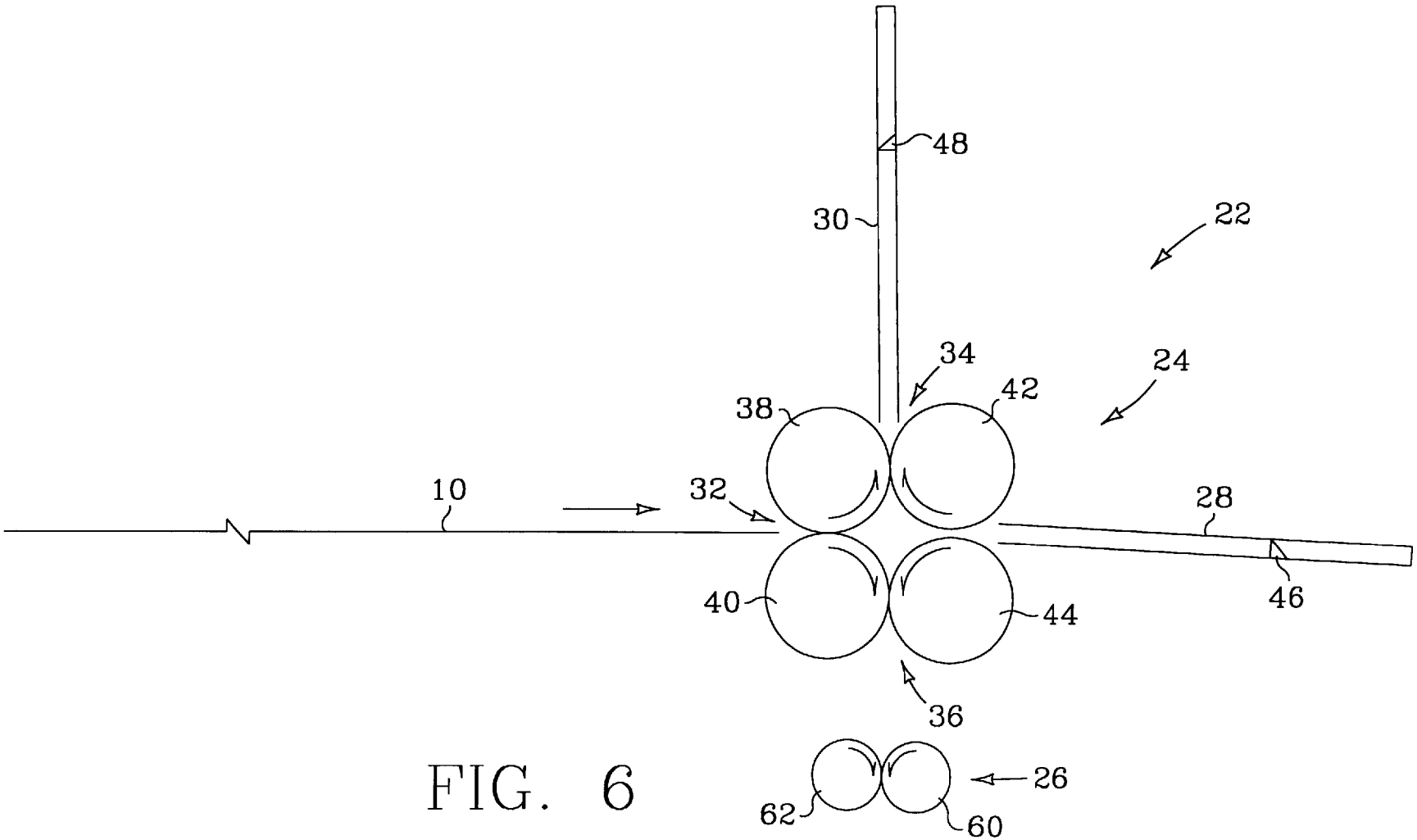
FIG. 6 is an elevation view of a folding and binding device constructed according to a second embodiment of the invention to form a "Z" shaped folded document.

FIG. 6 is a side elevation view of a folding and binding device 22 constructed according to a second embodiment of the invention to make a "Z" fold sheet 18. Referring to FIG. 6, binding device 22 includes a folder 24 and a binder 26. Folder 24 includes first and second buckle chutes 28 and 30 and input, intermediate and exit drivers 32, 34 and 36. In this embodiment, the rollers that form drivers 32, 34 and 36 are arranged generally adjacent to one another in a square. In this embodiment, rollers 38 and 40 form input driver 32, rollers 38 and 42 form intermediate driver and rollers 40 and 44 form exit driver 36. As with the embodiment of FIG. 3, optional adjustable stops 46, 48 are positioned in each buckle chute 28,30 to define the depth of the chute and, correspondingly, to set the position of each fold. If stops 46, 48 are omitted, each chute 28, 30 is made just long enough to make the folds at the desired position on sheet 10.

Figure 7A:
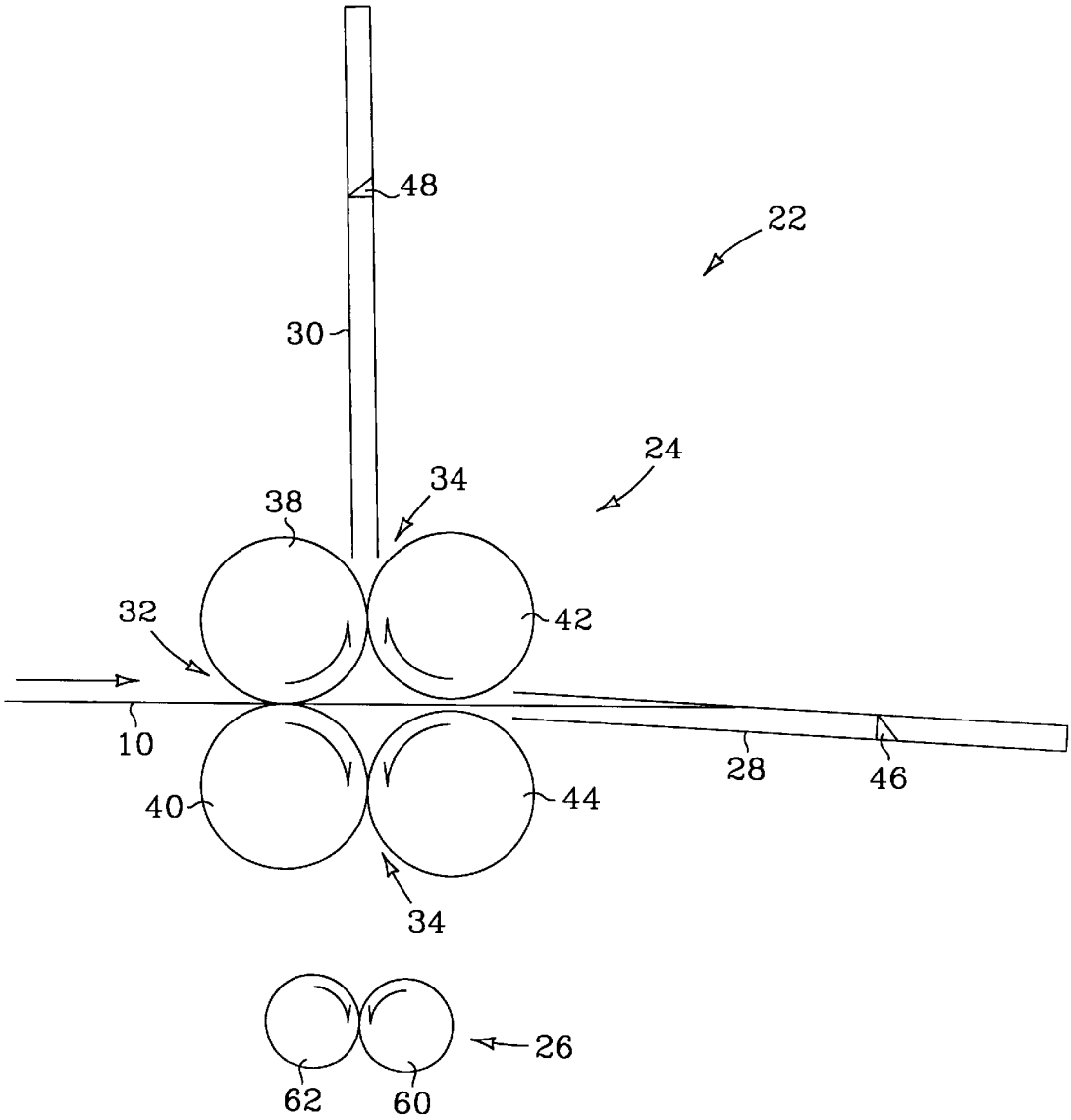
FIGS. 7A–7D are sequential elevation views of the folding and binding device of FIG. 7 showing a media sheet being folded.
Figure 7B:
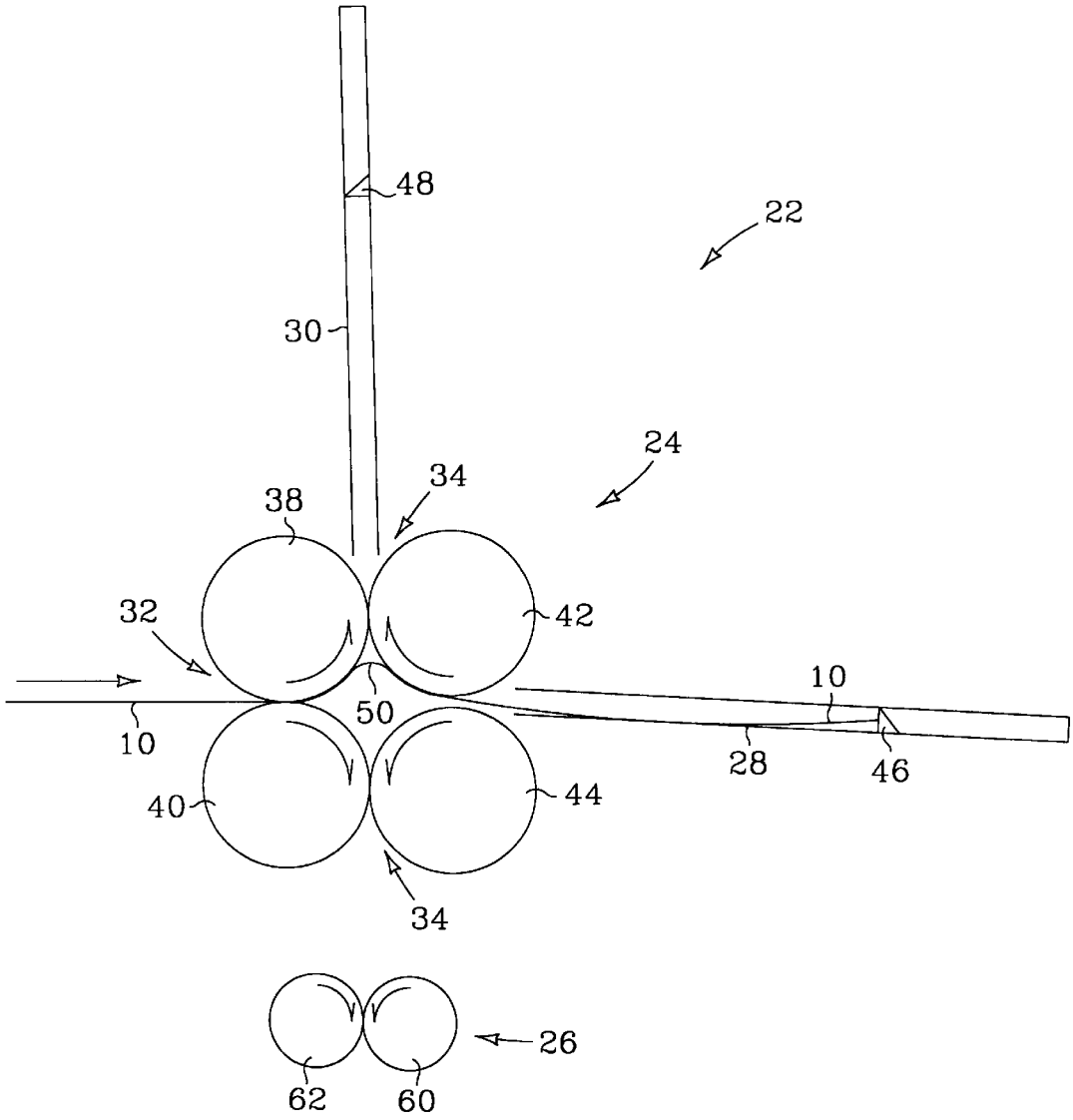
Figure 7C:
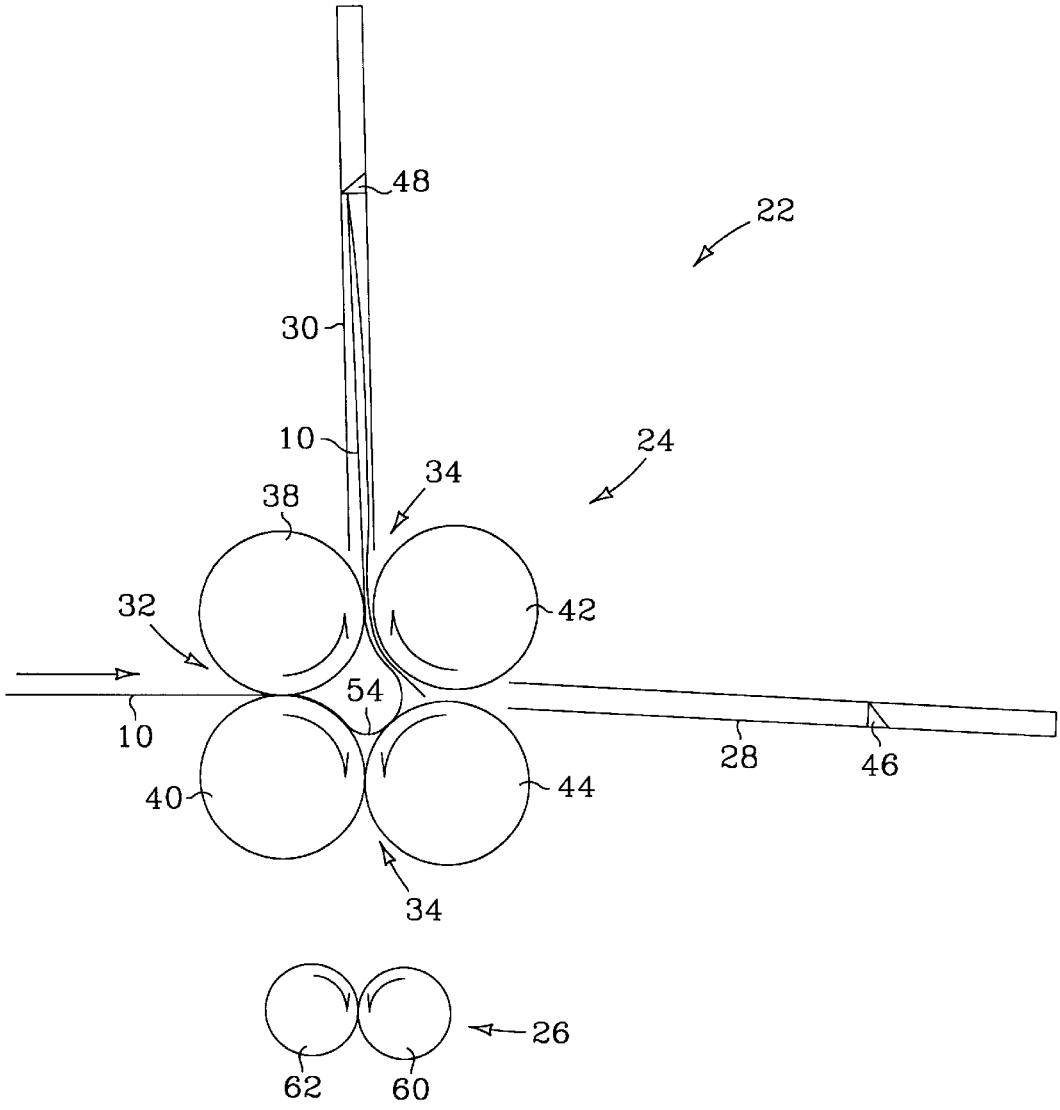
Figure 7D:
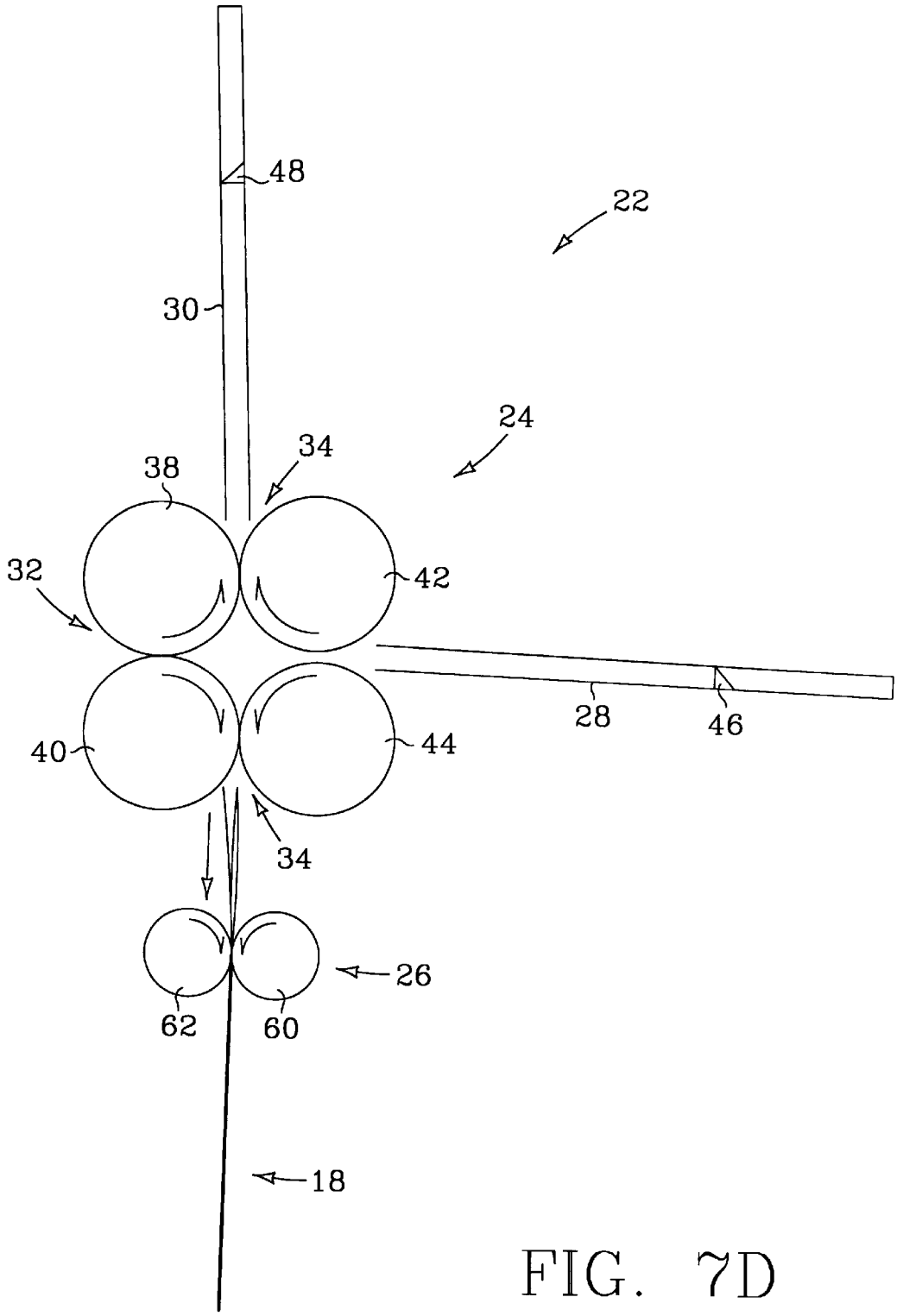

The sequence of operations to make "Z" fold sheet 18 will now be described with reference to FIGS. 7A–7D. Referring first to FIGS. 7A and 7B, input driver 32 receives the leading edge media sheet 10 and feeds the sheet into first buckle chute 28. As the leading edge reaches adjustable stop 46 and input driver 32 continues to feed media sheet 10, sheet 10 buckles along a first fold line 50. Referring now also to FIG. 7C, intermediate driver 34 receives sheet 10 at first fold line 50, creates the first fold along first fold line 50, and feeds media sheet 10 into second buckle chute 30 until the first fold reaches adjustable stop 48. When the first fold reaches stop 48, roller 42 is triggered to move away from roller 38 to allow sheet 10 to move back down between rollers 38 and 42. Referring to FIGS. 7C and 7D, intermediate driver 34, continuing to feed media sheet 10, creates a second buckle along a second fold line 54. Exit driver 36 receives sheet 10 at second fold line 54, creates a second fold along second fold line 54, and expels folded media sheet 18 to binder 26.

Figure 8:
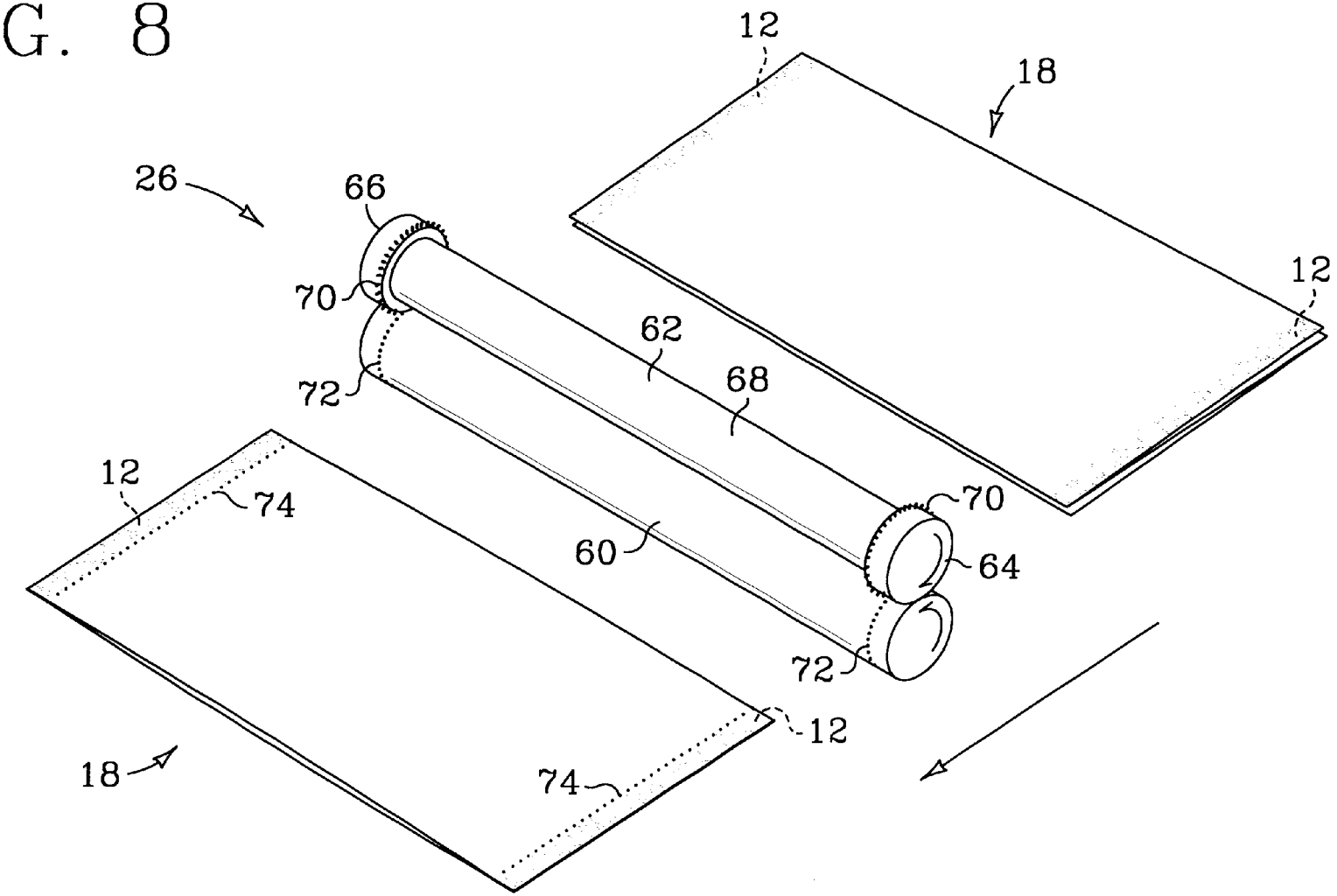
FIG. 8 is a perspective view of a second embodiment of a heated fuser used to reactivate toner to bind folded sheets only along the sides of the sheets.

Referring back to FIG. 1, to prevent the printed images on media sheet 10 from adhering to an adjacent panel 16 during the reactivation process, binding regions 12 may be selectively located along just the sides, one or both sides, of sheet 10. Referring now to FIG. 8, to bind the panels together along the sides of sheet 10, heated fusing roller 62 includes first and second fusing roller portions 64, 66 and main roller portion 68. First and second fusing roller portions 64, 66 are shaped and placed along each end of heated fusing roller 62 generally corresponding to the width of media sheet 10 at the expected locations of binding regions 12. First and second fusing roller portions 64, 66 each have a diameter greater than the diameter of main roller portion 68. Main roller portion 68 may be constructed of a heat resistant material. Consequently, as binder 26 receives folded sheet 18, first and second fusing roller portions 64, 66 in cooperation with pressure roller 60 selectively compress adjacent panels 16 and selectively heat binding regions 12 to reactivate the imaging material applied to the binding regions and bind the panels together.

Still referring to FIG. 8, binder 26 may also operate to perforate folded sheet 18 allowing the recipient of a bound letter to more easily open the letter tearing away the bound portions located along the sides of media sheet 10. One version of a perforator is shown in FIG. 8. First and second fusing roller portions 64, 66 of heated fusing roller 62 each include a plurality of punches 70 uniformly spaced around the circumference of each fusing roller portion 64, 66. Pressure roller 60 may have a plurality of dies 72 correspondingly located and uniformly spaced to accept punches 70, or pressure roller 60 may be made of a flexible material to suitably accept punches 70 as both rollers 60, 62 receive, compress, and bind folded sheet 18. In operation, punches 70 create perforations 74 as folded sheet 18 is fed through both rollers 60, 62. Preferably, punches 70 and dies 72 are located such that folded sheet 18 is perforated just inside binding regions 12.

Figure 9:
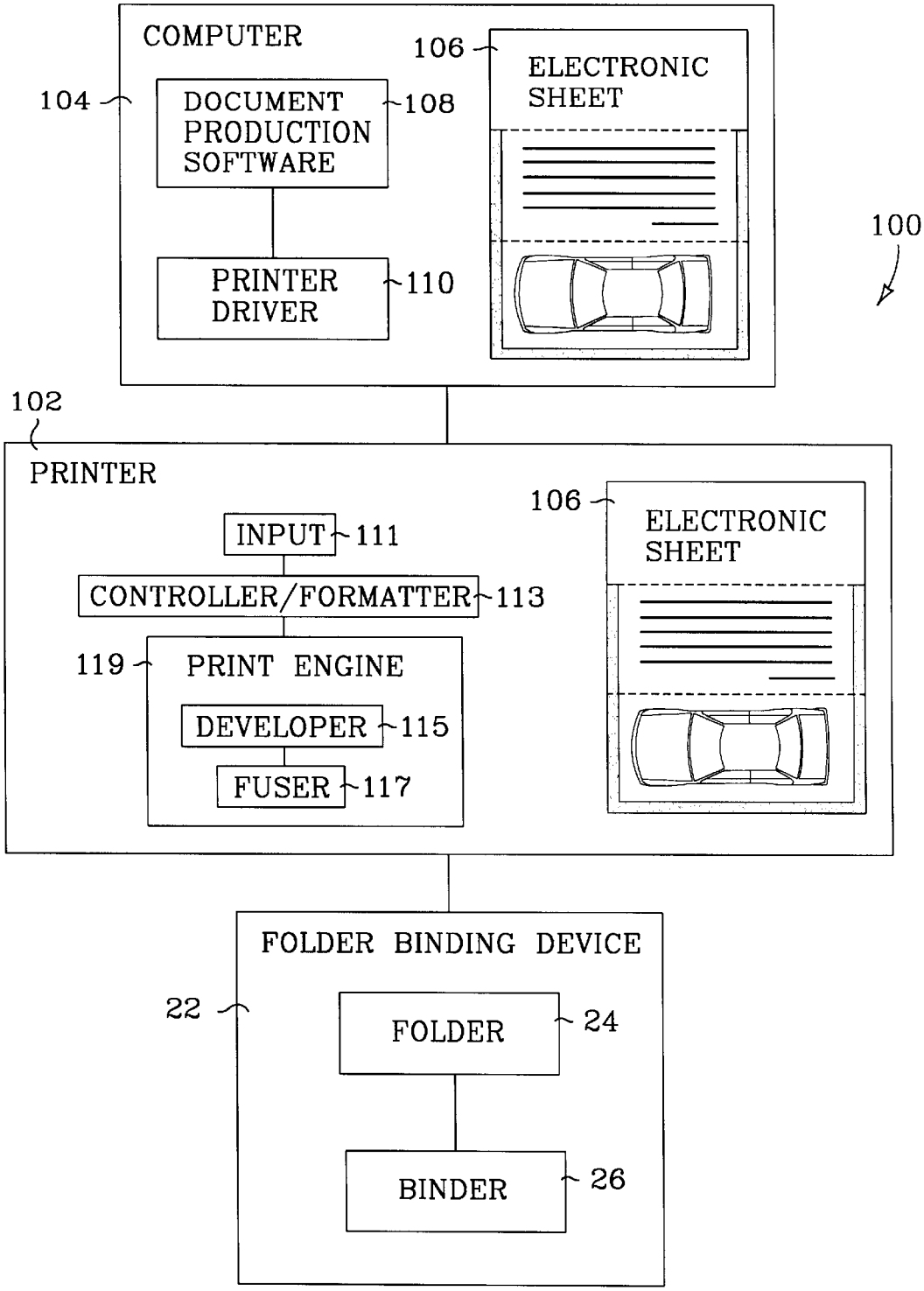
FIG. 9 is a block diagram representing a system for creating, printing, folding and binding media sheets.

FIG. 9 illustrates a second embodiment of the invention which is directed to a system 100 for creating, printing, folding and binding media mailable letters. In addition to folding and binding device 22 described above, system 100 includes an image forming device 102 such as a laser printer, a copier or a facsimile machine. Image forming device 102, folder 24, and binder 26 may be separate components or combined into a single appliance. Image forming device 102 is electronically coupled to a computer 104. Computer 104 may be programmed to generate and/or retrieve a desired print image in electronic form 106 and to transmit electronic print image 106 to image forming device 102 instructing image forming device 102 to create the desired print image on media sheet 10. This programming may generally be accomplished by document production software 108 in combination with a printer driver 110. However, system 100 does not necessarily require computer 104. Instead, image forming device 102 may itself perform the functions of computer 104.

Computer 104, utilizing software 108 and printer driver 110, transmits the electronic data representing the desired print image 106 to image forming device 102. Binding regions 12 applied may be defined by the software 108 or printer driver 110 and sent on to image forming device 102 along with or as part of the desired print image data 106. Alternatively, binding regions 12 may be defined by image forming device 102. Image forming device 102 applies imaging material in the pattern of the desired print image 106 and to binding regions 12 on one or both sides of media sheet 10. Image forming device 102 activates the imaging material (fuses the toner if laser toner is used) and expels media sheet 10 to folding and binding device 22 which, as described above, includes folder 24 and binder 26.

In this embodiment, the position of adjustable stops 46 and 48 in buckle chutes 28 and 30 (shown in FIG. 3) is controlled electronically by image forming device 102 or computer 104. The position of stops 46 and 48 determines the placement of fold lines 14. Considering a three panel fold, for example, as shown in FIGS. 1 and 2, the length L1 of the first panel P1 corresponds to the placement of adjustable stop 46 in first buckle chute 28. The length L2 of the second panel P2 corresponds to the placement of adjustable stop 48 in second buckle chute 30. The length L3 of the third panel P3 corresponds to the length L of media sheet 10 minus lengths L1 and L2 of the first two panels P1, P2.

Image forming device 102 is depicted as a laser printer in FIG. 9. Although it is expected that the binding techniques of the present invention will be most often used with and embodied in electrophotographic printing devices such as the laser printer illustrated in FIG. 9, these techniques could be used with and embodied in various other types of image forming devices. Referring again to FIG. 9, document production software 108 and printer driver 110 transmit data representing the desired print image and binding regions to input 111 on laser printer 102. The data is analyzed in the printer's controller/formatter 113, which typically consists of a microprocessor and related programmable memory and page buffer. Controller/formatter 113 formulates and stores an electronic representation of each page that is to be printed, including the print image and the binding regions. In addition to formatting the data received from input 111, controller/formatter 113 drives and controls the toner development unit 115, fuser 117 and other components of print engine 119.

Figure 10:
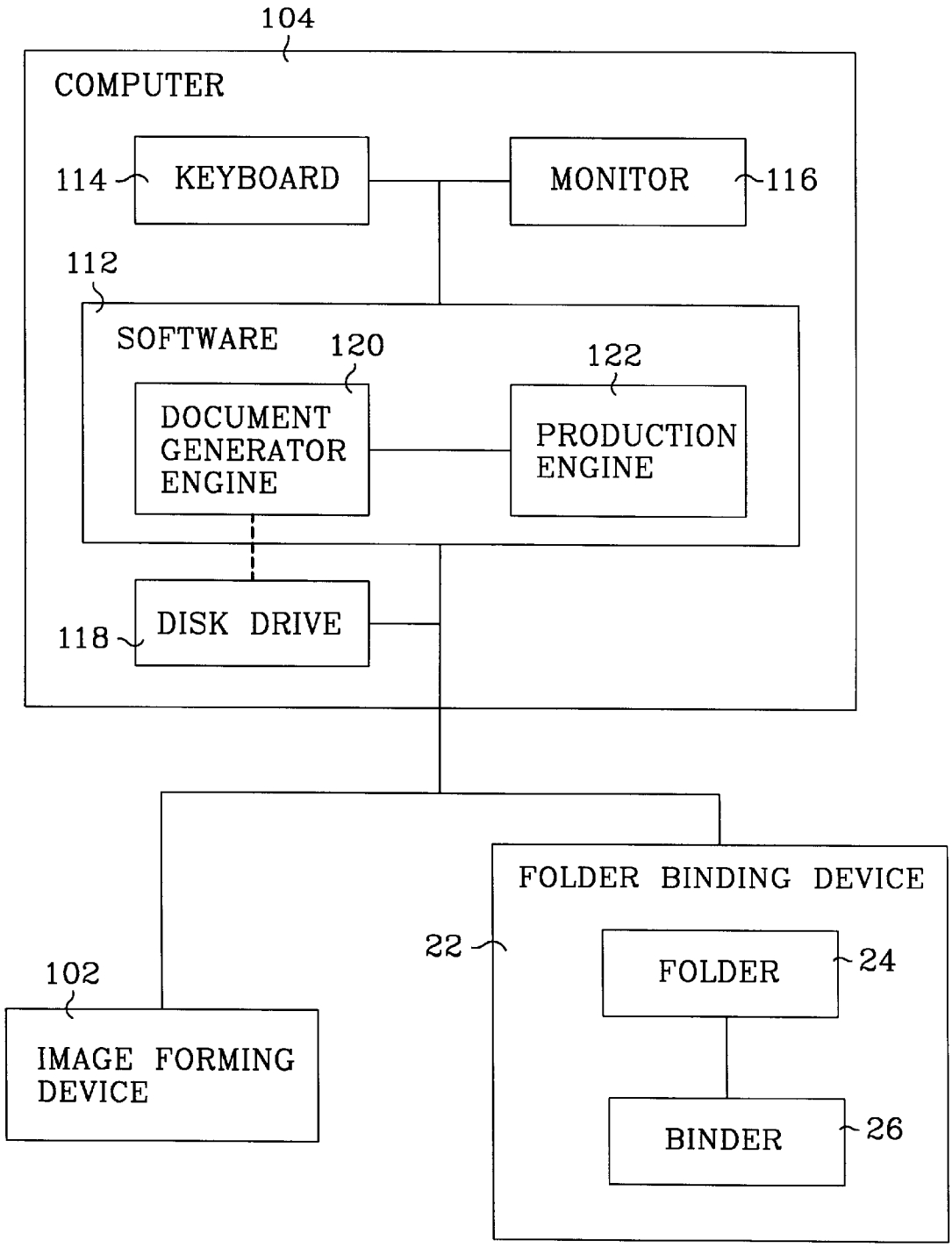
FIG. 10 is a block diagram representing a computer software product for creating, printing, folding and binding media sheets.

Another embodiment of the invention, described with reference to FIG. 10, is directed to a computer software product for creating mailable letters or other types of folded and bound documents. The software product, generally designated by reference number 112, operates on computer 104 in electronic communication with image forming device 102, folder 24, and binder 26. Computer 104 includes a user input device 114 such as a keyboard, a user readable display 116 such as a monitor, and an electronic storage device 118 such as a computer disk drive. Software 112 includes an image generating engine 120 such as a word processor and/or graphics generator and a production engine 126. Generating engine 120 may be designed similar to, may include, or may be made an integral part of a commercially available document production software such as Microsoft® Word, WordPerfect®, Microsoft® Publisher, Adobe Photoshop®. Generating engine 120 allows the user to create a desired print image in electronic form. Generating engine 120 also allows a user to retrieve a desired print image electronically stored or otherwise retrievable from electronic storage device 118 or from a number of other electronic sources such as a scanner, a digital copier or a digital camera.

The user may then instruct generating engine 120 to transmit the electronic data representing the print image to production engine 122. Depending upon the size and other characteristics of the print image, production engine 122 automatically or through user instruction selects an appropriate media sheet 10 and defines binding regions 12. Production engine 122 also directs image forming device 102 to apply imaging material to media sheet 10 in the form of the desired print image, to apply imaging material to the defined binding regions 12, and to activate the imaging material. Finally, production engine 122 directs folder 24 to fold media sheet 10 and instructs binder 26 to reactivate the imaging material applied to binding regions 12. In one version of software 112, the user may select the location of fold lines 14 on media sheet 10. To do so, production engine 122 communicates with folder 24 and directs placement of adjustable stops 46, 48 in one or more buckle chutes 28,30. Correspondingly, the user may elect to create a single fold even though media sheet 10 passes through two buckle chutes. The user may also select media sheets 10 of differing sizes requiring varying placement of fold lines 14. In operation, the user, generating engine 120, or production engine 122 selects a media sheet 10 and the number and placement of fold lines 14. Taking into consideration the length L of media sheet 10 and the number and placement of fold lines 14, production engine 122 determines the length L1, L2 and L3 of each panel P1, P2, P3 and directs folder 24 to set adjustable stops 46,48 accordingly. For example, adjustable stop 46 will be set to a depth substantially equal to L1 and adjustable stop 48 is set to a depth substantially equal to L2 for the tri-fold sheet illustrated in the Figures.

In another version of software 112, the user may select the strength of the inter-panel bond created by the reactivated imaging material. If the user chooses a stronger bond, production engine 122 defines relatively large binding regions 12 and/or instructs image forming device 102 to apply imaging material more densely to binding regions 12. If the user chooses a weaker bond, production engine 122 defines relatively small binding regions 12 and/or instructs the image forming device 102 to apply imaging material more sparsely to binding regions 12.

Figure 11:
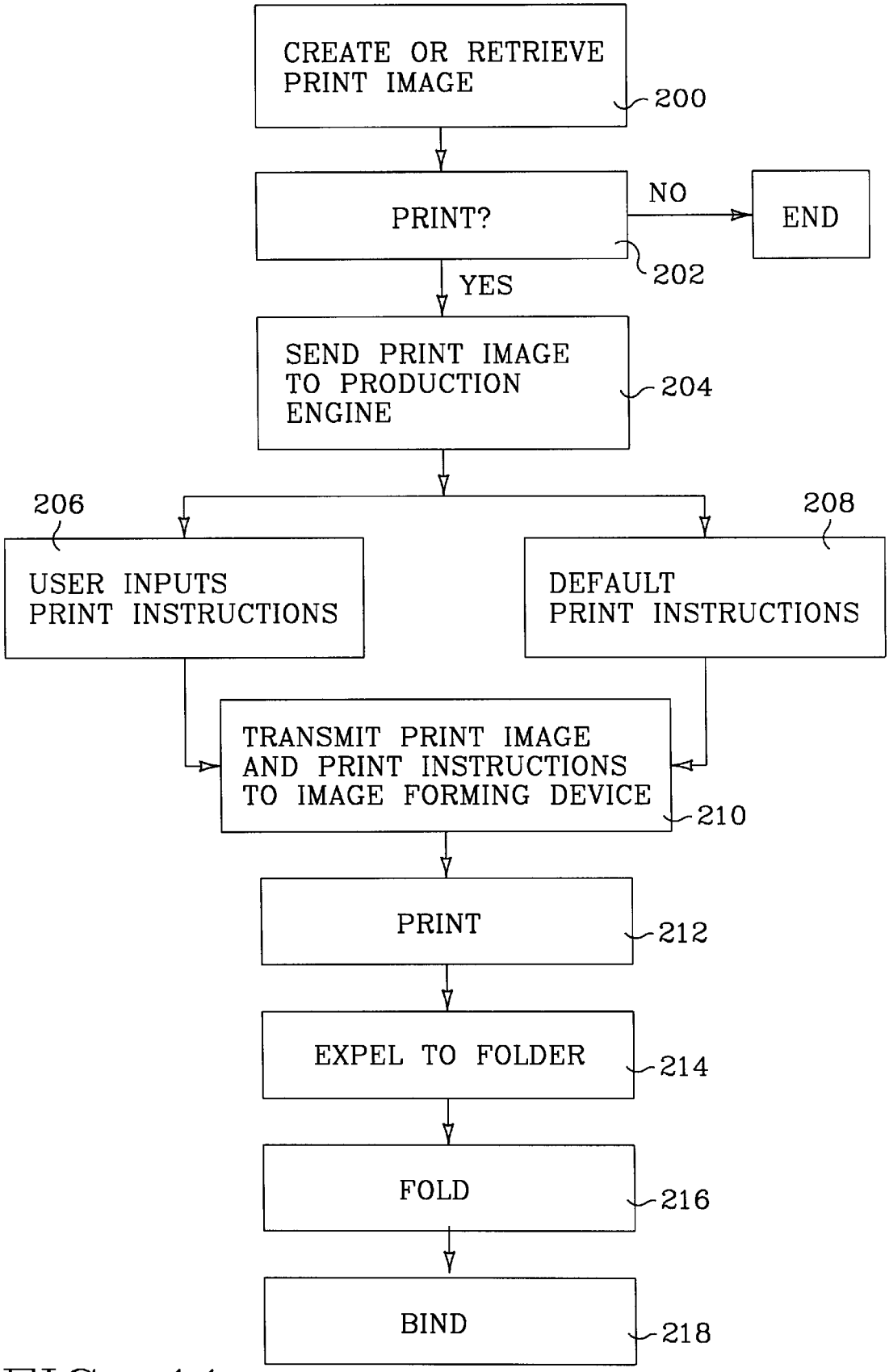
FIG. 11 is a flow diagram illustrating one method for printing, folding and binding media sheets.

Another embodiment of the invented software 112 will now be described with reference to the flow diagram of FIG. 11. Document generating engine 120 allows the user to create or retrieve a print image in electronic form 30 (step 200). Once created or retrieved, the user may elect to print the image to one or more media sheets 10 (step 202). Upon receiving a print command, generating engine 120 sends the print request and electronic data representing the print image to production engine 122 (step 204). Production engine 122 requests print instructions from the user including, but not limited to, the number of copies to be produced, the size of media sheet 10, whether media sheet 10 is to be folded and/or sealed, the number of folds, the location of the fold lines 14, the location of binding regions 12, and the strength of the seal (step 206). Alternatively, the user may select default settings allowing production engine 122 to automatically make some or all of the above selections (step 208).

Next, production engine 122 transmits data representing the desired print image to image forming device 102 along with the specific print instructions determined above (step 210). In accordance with those instructions, image forming device 102 prints each sheet by applying imaging material to a media sheet in the form of the desired print image, if media sheet 10 is to be sealed, applying imaging material to binding regions 12 and activating the imaging material (step 212). If media sheet 10 is to be folded and sealed, production engine 122 instructs image forming device 102 to expel media sheet 10 to folder 24 (step 214) and folder 24 to place adjustable stops 46, 48 in each buckle chute 28, 30 in accordance with the selected location of fold lines 14. Folder 24 folds media sheet 10 (step 216) and sends it to binder 26 to reactivate the imaging material applied to binding regions 12 to bind the folded panels (step 218).

"Software" as used herein means any computer useable medium having computer readable instructions thereon for causing a computer to perform the desired task or operation. "A" something as used herein means one or more of that something unless expressly stated otherwise. For example, "a buckle chute" recited in the claims means one or more buckle chutes and "a binder" means one or more binders.

The present invention has been shown and described with reference to the foregoing exemplary embodiments. It is to be understood, however, that other forms, details, and embodiments may be made without departing from the spirit and scope of the invention which is defined in the following claims.

What is claimed is:

1. An apparatus for folding and binding a media sheet, the media sheet having imaging material applied thereto and activated in a binding region, the apparatus comprising:

a buckle chute;

a binder downstream in the paper path from the buckle chute, the binder operative to reactivate imaging material applied to the binding region of the media sheet;

an input driver proximate to the buckle chute and upstream in the paper path from the buckle chute, the input driver operative to direct the media sheet into the buckle chute and, in cooperation with the buckle chute, buckle the media sheet along a fold line; and an exit driver proximate to the buckle chute and downstream in the paper path from the buckle chute between the buckle chute and the binder, the exit driver operative to receive the media sheet from the buckle chute, fold the media sheet along the fold line and direct the folded sheet towards the binder.

2. The apparatus according to claim 1, wherein the imaging material is toner and the binder comprises a toner fuser.

3. The apparatus according to claim 1, further comprising an adjustable stop disposed in the buckle chute to variably limit the depth of the chute.

4. The apparatus according to claim 1, wherein the input driver comprises a first pair of rollers forming a first nip therebetween through which the media sheet is directed into the buckle chute and the exit driver comprises a second pair of rollers forming a second nip therebetween through which the media sheet is received from the buckle chute, folded and directed towards the binder.

5. The apparatus according to claim 1, wherein the buckle chute is a single buckle chute and the input driver comprises first and second rollers forming a first nip therebetween through which the media sheet is directed into the buckle chute and the exit driver comprises the second roller and a third roller forming a second nip therebetween through which the media sheet is received from the buckle chute, folded and directed towards the binder.

6. The apparatus according to claim 2, wherein the fuser comprises a heated fusing roller and a pressure roller disposed immediately adjacent the fusing roller, heat and pressure being applied to at least the binding region of the folded media sheet as it passes between the rollers.

7. The apparatus according to claim 2, wherein the fuser comprises a heated fusing roller and a pressure roller disposed immediately adjacent the fusing roller, heat and pressure being applied to only the binding region of the folded media sheet as it passes between the rollers.

8. The apparatus according to claim 7, wherein the heated fusing roller includes a center portion and first and second end portions disposed at opposite ends of the center portion, each end portion having a diameter greater than the diameter of the center portion for applying heat and pressure only at the end portions of the roller.

9. The apparatus according to claim 8, further comprising a plurality of punches spaced around the end portions of the heated fuser roller, the punches configured to perforate the media sheet as the folded sheet passes between the fuser roller and the pressure roller.

10. The apparatus according to claim 8, further comprising a plurality of punches spaced around end portions of the pressure roller, the punches configured to perforate the media sheet as the folded sheet passes between the fuser roller and the pressure roller.

11. An apparatus for folding and binding a media sheet, the media sheet having imaging material applied thereto and activated in a binding region, the apparatus comprising:

a first buckle chute;

a second buckle chute;

a binder downstream in the paper path from the second buckle chute, the binder operative to reactivate imaging material applied to the binding region of the media sheet;

an input driver proximate to the first buckle chute and upstream in the paper path from the first buckle chute, the input driver operative to direct the media sheet into the first buckle chute and, in cooperation with the first buckle chute, buckle the media-sheet along a first fold line;

an intermediate driver proximate to the first and second buckle chutes and downstream in the paper path from the first buckle chute between the first and second buckle chutes, the intermediate driver operative to receive the media sheet from the first buckle chute, fold the sheet along the first fold line, direct the once folded media sheet into the second buckle chute, and then, in cooperation with the second buckle chute, buckle the once folded media sheet along a second fold line; and an exit driver proximate to the second buckle chute and downstream in the paper path from the second buckle chute between the second buckle chute and the binder, the exit driver operative to receive the once folded media sheet from the second buckle chute, fold the once folded media sheet along the second fold line and direct the twice folded media sheet to the binder.

12. The apparatus according to claim 11, wherein the imaging material is toner and the binder comprises a toner fuser.

13. The apparatus according to claim 11, further comprising an adjustable stop disposed in each buckle chute to variably limit the depth of the chute.

14. The apparatus according to claim 11, wherein:

the input driver comprises first and second rollers forming a first nip therebetween through which the media sheet is directed into the first buckle chute;

the intermediate driver comprises the second roller and a third roller forming a second nip therebetween through which the media sheet is received from the first buckle chute, folded and directed to the second buckle chute; and the exit driver comprises the second roller and a fourth roller forming a third nip therebetween through which the media sheet is received from the second buckle chute, folded and directed to the binder.

15. The apparatus according to claim 11, further comprising one or more additional buckle chutes and one or more additional intermediate drivers, each additional intermediate driver operative to receive the media sheet from the preceding buckle chute, fold the sheet, direct the folded media sheet into the next buckle chute, and then, in cooperation with that buckle chute, buckle the folded media sheet along another fold line.

16. The apparatus according to claim 12, wherein the fuser comprises a heated fusing roller and a pressure roller disposed immediately adjacent the fusing roller, heat and pressure being applied to at least the binding region of the folded media sheet as it passes between the rollers.

17. The apparatus according to claim 12, wherein the fuser comprises a heated fusing roller and a pressure roller disposed immediately adjacent the fusing roller, heat and pressure being applied to only the binding region of the folded media sheet as it passes between the rollers.

* * * * *